United States Patent [19]

Baxter

[11] 3,970,209

[45] July 20, 1976

[54] COLLAPSIBLE CONTAINER

[76] Inventor: Alan Raymond Baxter, 44 Karen Crescent, Hamilton 43, Ontario, Canada.

[22] Filed: Aug. 28, 1974

[21] Appl. No.: 501,403

[30] Foreign Application Priority Data

May 15, 1974 Canada .....199972

[52] U.S. Cl. ..... 220/6; 220/1.5; 292/145

[51] Int. Cl.[2] ..... B65D 7/24; B65J 1/02; E05C 1/04

[58] Field of Search ..... 220/6, 1.5, 4 F, 83; 292/57, 145, 146, 147, 148, 149, 150, 151, 152, 153, 154,

[56] References Cited

UNITED STATES PATENTS

| | | | |
|---|---|---|---|
| 2,780,383 | 2/1957 | Coit, Jr. | 292/153 X |
| 3,428,204 | 2/1969 | Wilson | 220/83 X |
| 3,478,914 | 11/1969 | Williams | 220/4 F |

*Primary Examiner*—George E. Lowrance
*Assistant Examiner*—Steven M. Pollard

[57] ABSTRACT

An improved collapsible container is provided having a rectangular base and four side walls resting on a peripheral sill of the base. The sill and a floor in the base combined to define a well which receives the side walls when the container is collapsed. The side walls are preferably connected by latches which both interconnect the sides and allow angular movement of one side relative to another side for collapsing the container. The latches also permit two of the sides of the container to have upper parts which can be moved outwardly upon releasing the latches to provide access into sides of the container.

6 Claims, 10 Drawing Figures

COLLAPSIBLE CONTAINER

This invention relates to collapsible containers of the type used to store bulk components in store rooms and the like.

The present type of collapsible container commonly consists of a base and four walls made from horizontal and vertical rods welded to one another. The walls are interconnected in such a manner that they can be collapsed onto the base for storage of the container. Such containers often include legs so that one container can be stacked on another container either in the assembled or the disassembled condition.

It is desirable that collapsible containers of the present type are both robust and yet light and that they are readily folded from an assembled to a collapsed condition. Preferably, the walls can be folded in any order and the floor area required to collapse the container should be no larger than the base of the container. It is preferable that the collapsed container should be stackable and that after collapsing, the walls are protected within the base. In the assembled condition the containers should preferably provide access from two sides so that when the containers are in a stacked condition, the stacking need not be disturbed to gain access into the containers.

Accordingly, in one of its aspects, the present invention provides a latch which permits access from two sides of a collapsible container and which also facilitates collapsing the container. The latch has a bracket adapted to be attached to one of the walls adjacent a vertical corner of the container. This bracket defines a recess adapted to open inwardly of the container and a bolt is slidably located in the bracket so that on assembly of the latch on the container the bolt moves along a horizontal axis. Means are provided on the bolt to limit axial movement of the bolt between an engaged position in which the bolt extends across the recess and an disengaged position in which the recess is not closed by the bolt. The recess is adapted to receive a peripheral vertical rod of another wall at the corner of the container to releasably couple the one wall to this other wall at the corner of the container.

In another of its aspects, the invention provides an improved container in which the base protects the walls when the container is in the collapsed condition. The container includes a rectangular base having a four-sided peripheral sill and a floor extending between the sides of the sill to define a well. A pair of opposed side walls are moveably coupled to respective opposed sides of the sill for limited vertical movement and for angular movement towards the base. A pair of opposed end walls are coupled one to each of the respective side walls for angular movement with respect to the associated side wall whereby each end wall can be moved between a position in which the end wall rests on the sill between the side walls and a position in which the end wall is in face-to-face engagement with the associated side wall. Consequently each side wall and associated end wall can then be moved angularly into the well to disassemble the container. The aforementioned translational movement combining with said angular movement of the side walls to permit the side walls to enter the well whereby the walls are then in a disassembled condition and stored in the well below the level of the upper extremities of the sill. Latch means are provided and coupled to the walls to retain the walls in an assembled condition in which each wall rests on a respective one of the sides of the sill.

These and other aspects of the invention will be better understood with reference to the drawings in which.

Figure 1:
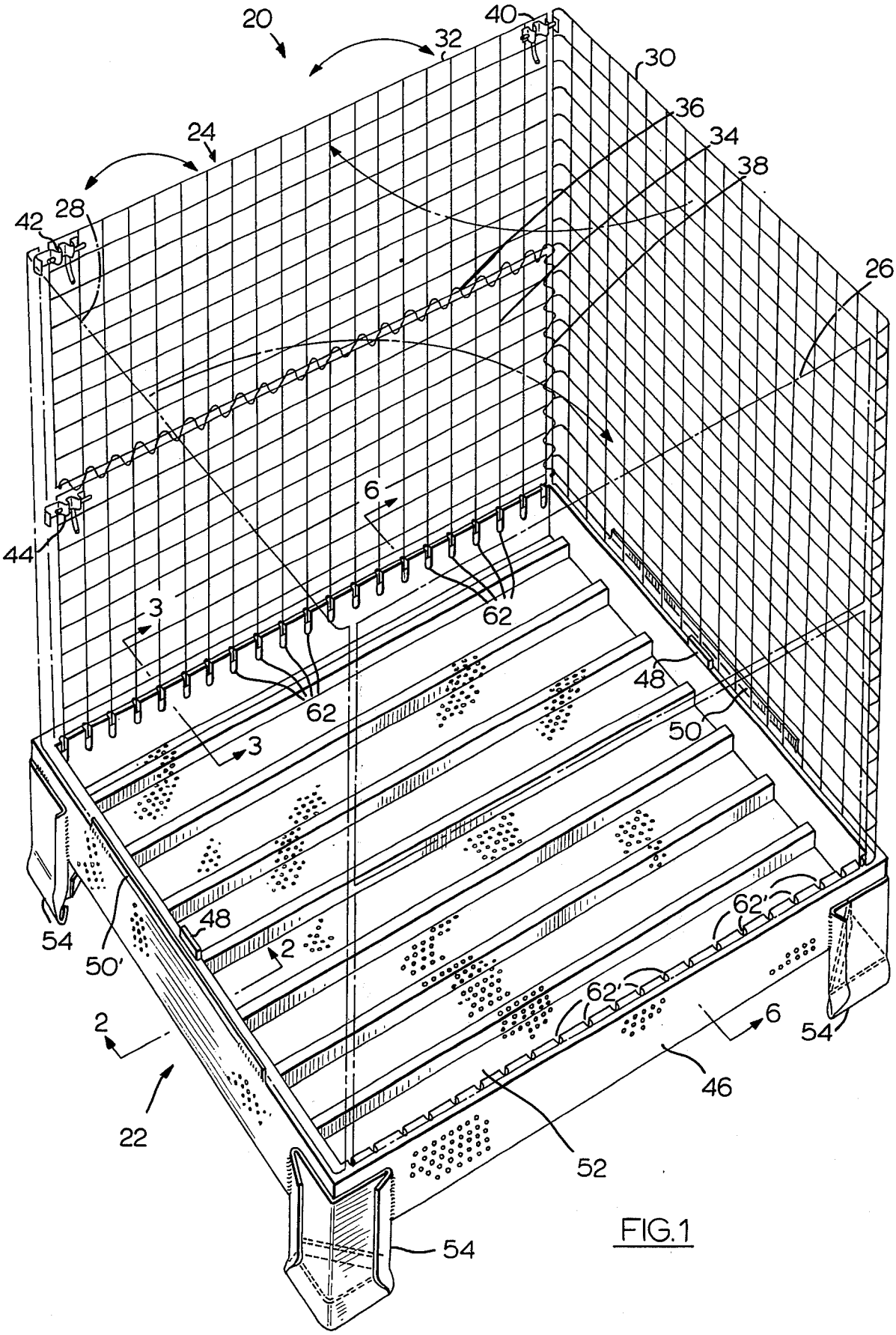
FIG. 1 is a perspective view of an assembled collapsible container embodying the invention with part of the container shown in ghost outline.

Reference is first made to FIG. 1 which illustrates a collapsible container 20 comprising a base 22, respective first and second side walls 24, 26, and respective first and second end walls 28, 30. The walls 24 and 30 are shown in full outline and the walls 26, 28 are shown in ghost outline to simplify the drawing. The walls 26, 28 are similar to the respective walls 24, 30 and are connected to one another in a similar fashion to the connection between the walls 24 and 30. All of the walls are constructed from vertical rods welded to horizontal rods.

In general, the arrangement of the four walls is such that the end wall 30 can be rotated into face-to-face engagement with the side wall 24 to permit these walls to be folded downwardly into the base 22. Similarly, the end wall 28 can be moved into engagement with the side wall 26 before folding these walls downwardly into the base 22. The order in which the walls are folded into the base is immaterial because the base 22 allows folding of the side walls in any order to disassemble the container. On assembly, the walls are repositioned as shown in FIG. 1 and then connected to one another to retain the assembly in an upright relatively rigid condition.

The walls 24 and 30 will now be described in detail. As mentioned, these walls are typical also of walls 26, 28 so that the following description of the walls 24, 30 will also apply to the walls 26, 28.

When containers of this type are stacked, it is convenient to be able to gain access into the container from a side wall when a further container is on top of the container in question. Although this is not always necessary, it is an advantageous feature. In FIG. 1, the wall 24 consists of an upper part 32 hingably connected to lower part 34 by a conventional spiral hinge 36. The spiral hinge 36 is wrapped loosely around adjacent horizontal rods of the parts 32, 34 so that the upper part 32 can be moved angularly outwards to provide access into the container. Similarly, a hinge 38 connects a peripheral vertical rod of the lower part 34 to adjacent vertical rod of the end wall 30. This rod of the wall 30 lies generally in a plane containing the side wall 24 because it is connected to cranked ends of horizontal rods forming the end wall 30. Such a structure is commonly used in the art so that when the end wall 30 is folded into engagement with the side wall 24, the cranked ends of the horizontal rods ensures that the walls 30 and 24 will lie loosely adjacent one another without stressing the hinged connection between the walls.

The upper part 32 of the side wall 24 has a latch 40 attached to it to hold the upper part in an upright position. This latch allows rotation of the end wall 30 relative to the side wall 24 as will be described. Similar latches 42, 44 connect the side wall 24 to the end wall 28 when the container is in the assembled position shown in FIG. 1. Although further latches are not shown, it will be appreciated that there is a latch corresponding to latch 40 between the end wall 28 and the side wall 26, and also that there are latches corresponding to the latches 42, 44 on the side wall 26 and in engagement with the end wall 30.

The upper part 32 of the side wall 24 can be rotated outwardly and downwardly after releasing the latches 40, 42 to provide access into the container and a similar upper part of the wall 26 can also be used to provide access from the other side of the container.

Returning to the end wall 30, it will be seen that the horizontal rods of this end wall are also cranked at their other extremities where they are adjacent the side wall 26. Consequently, the end wall 30 is symmetrical about a central vertical line. Also, this wall rests on the top of a rectangular peripheral sill 46 forming part of the base 22 and is located on the sill by an inner lip 48 and by a larger outer lip 50 attached to the sill. The lip 50 is larger to prevent dislocation of the end wall caused by a load in the container and may extend along the full length of this portion of the sill. Similar lips 48′, 50′ are provided on the sill to locate the end wall 28.

Portions of the peripheral sill 46 below the side walls 24, 26 are arranged to combine with these side walls to permit the side walls to fold down into the base below the level of the upper extremities of this sill. These sill portions will be described subsequently with reference to FIG. 3.

The base 22 consists essentially of the rectangular sill 46 and a corrugated floor 52 attached to the sill 46 and recessed below the upper extremity of the sill to define a well to receive the walls as will be described. Four corner legs 54 (three of which can be seen in this figure) complete the base. The structure of these legs will be described in more detail with reference to FIG. 3. The purpose of the legs is primarily to support the sill and floor off the ground for lifting using a fork lift vehicle and also to allow stacking of one container on another. This stacking can take place either with the containers in an assembled condition as seen in FIG. 1 or in a disassembled condition in which the sides are in the well defined by sill 46 and by floor 52 as will be described with reference to FIG. 6.

Figure 2:
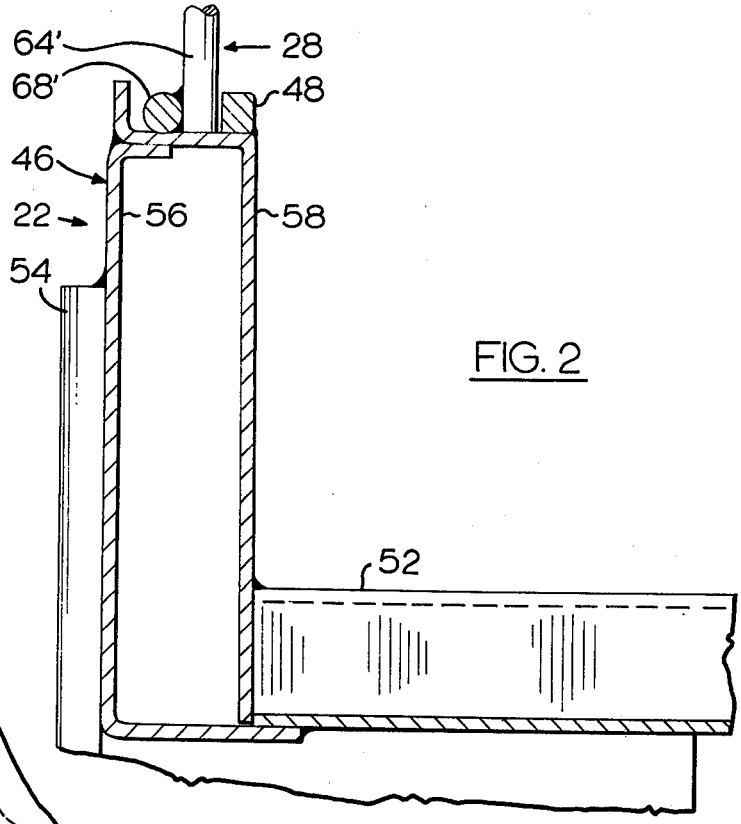
FIG. 2 is a sectional view on line 2 — 2 of FIG. 1.
Figure 3:
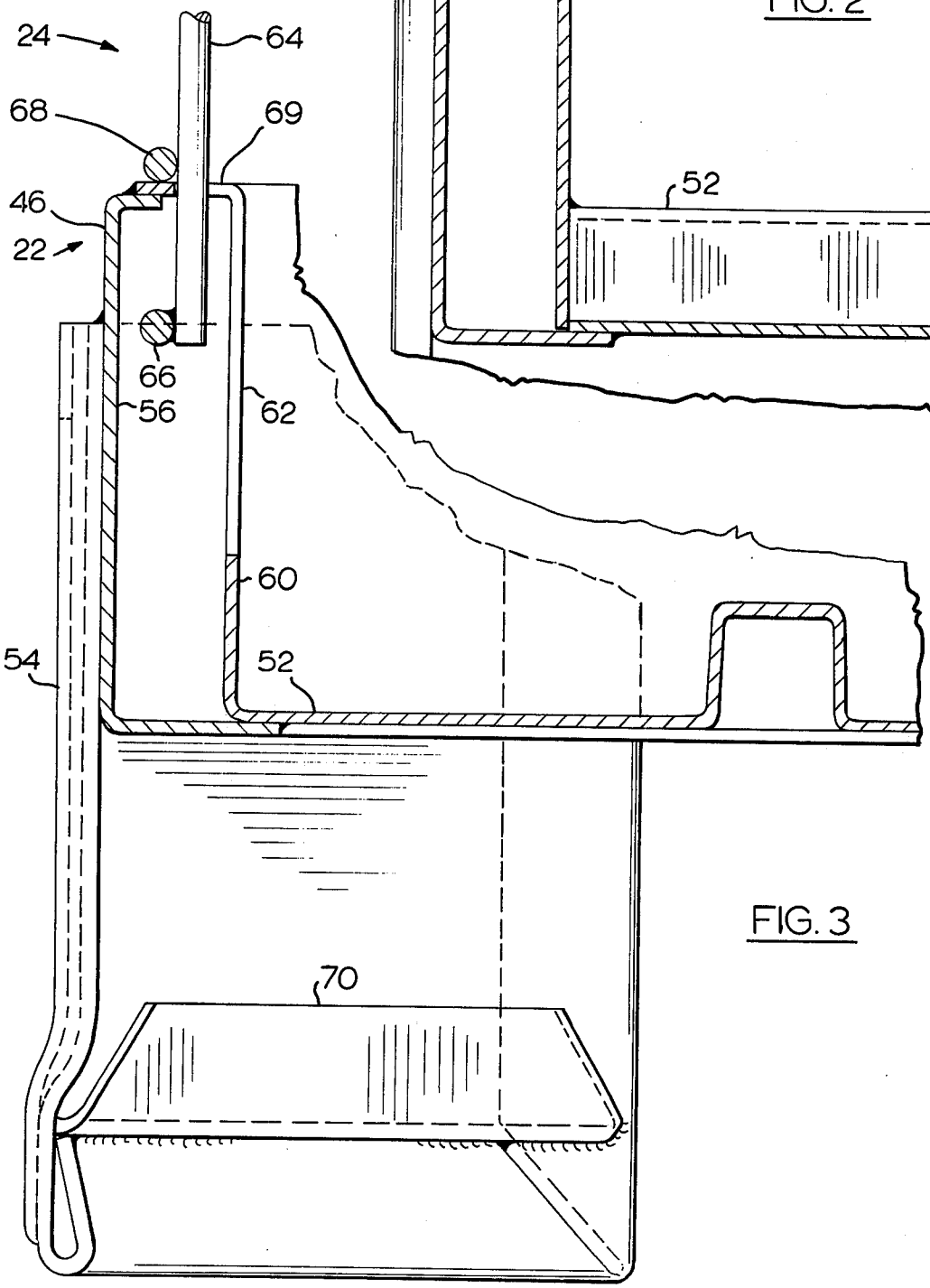
FIG. 3 is a sectional view on line 3 — 3 of FIG. 1.

Reference is now made to FIGS. 2 and 3 initially to describe structural details of the base 22 and subsequently to describe the connection between the base and the side wall 24. The portion of the sill below end wall 28 is shown in FIG. 2. This portion is typical also of the portion below wall 30 and consists essentially of an outer section 56 having a generally U-shaped cross section with a lower one of the limbs longer than the other, and an inner section 58 which is generally Z-shaped in cross section. The sections 56, 58 are welded together to form a box-section and the lower limb of the section 56 projects inwardly beyond the section 58 to support the floor 52. An upright upper portion of the section 58 defines the lip 50′ described with reference to FIG. 1.

The portions of the sill below the side walls 24, 26 are similar and the portion under side wall 24 is shown in FIG. 3. The outer section 56′ is similar to the section 56 shown in FIG. 2. However, an inner section 60 forms a continuation of the floor 52 and is welded at its outer extremity to the section 56′ to define a box section. This box section has similar interior dimensions to the box section shown in FIG. 2 to permit the sill to be assembled by welding the corners either at lap joints or at mitre joints as preferred.

The sill section 60 defines a series of vertically orientated slots 62 (also seen in FIG. 1) located to receive respective vertical rods 64 of the side wall 24. Similarly, slots 62′ (FIG. 1) occur in the sill below wall 26 to receive vertical rods of this wall. Lower extremities of the rods 64 are interconnected by a horizontal rod 66 which is trapped within the box section defined by the section 56′ and 60 during manufacture. A further horizontal rod 68 is parallel to the rod 66 and attached to the vertical rods 64 for line contact with the sill to support the side wall 24. This arrangement ensures proper transfer of load from the vertical rods 64 to the base 22 when assembled containers 20 are stacked on top of one another. Similarly, as seen in FIG. 2, the end wall 28 is also adequately supported because vertical rods 64′ of this wall rest on the sill in end contact therewith and the vertical rods are connected to one another by a horizontal rod 68′ which is also in contact with the sill. It will now be evident that all four walls of the container 20 are adequately supported on the sill 46 when in the assembled condition.

The slots 62 extend vertically in the inner section 60 and continue into an outwardly-extending top portion 69. As a result the wall 24 can move angularly into the base and the slots also permit translational vertical movement so that the wall can enter the base well as will be described with reference to FIG. 6.

As seen in FIG. 3, the slot 62 permits the side wall 24 to be moved inwardly towards the floor 52 guided by the loose location of the horizontal rod 66 within the sill 46. This movement will be further described with reference to FIG. 6 which shows the container 20 in a collapsed condition.

As also seen in FIG. 3, one of the container legs 54 is welded to a corner of the sill and extends downwardly below the floor 52 of the base 22 and includes a brace 70 inside the leg for resting on upper extremities of another container when this container is stacked on such a container. Below the brace 70, the leg 54 is deformed outwardly to locate either on the respective walls of this other container or on its base if the other container is disassembled.

Figure 5:
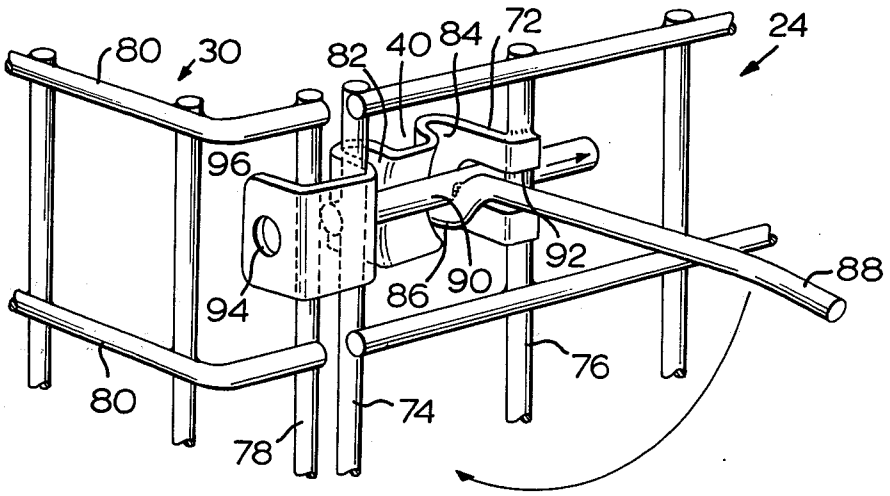
FIG. 5 is a view similar to FIG. 4 showing the latch in an open position.
Figure 4:
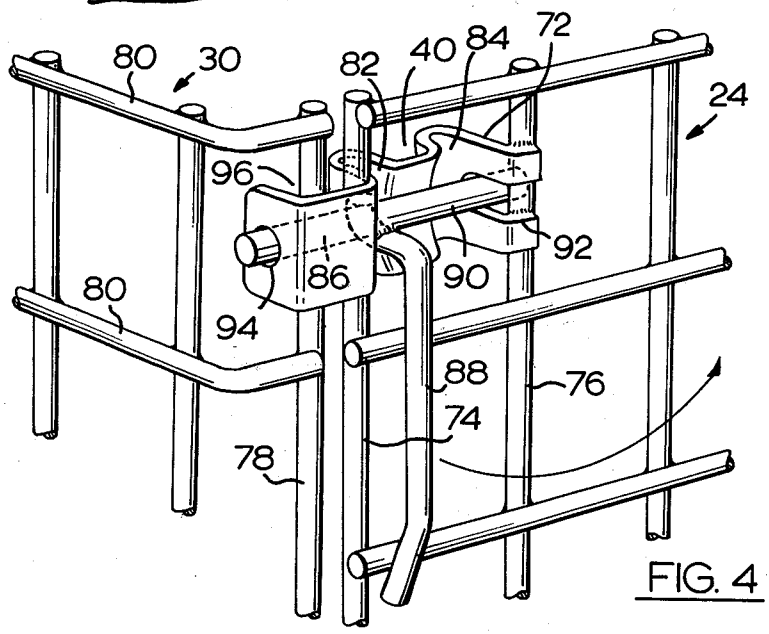
FIG. 4 is a perspective view of a latch used in the FIG. 1, embodiment and showing the latch in a closed position.

Reference will now be made to FIGS. 4 and 5 to describe the latch 40 which is typical of all other latches used on the container 22 (FIG. 1). As seen in FIG. 4, latch 40 is in an engaged position and it includes a bracket 72 attached to a peripheral vertical rod 74 and to an adjacent vertical rod 76 of the side wall 24. The latch 40 engages a vertical rod 78 of the end wall 30. In the assembled condition the rod 78 lies generally in a plane containing the side wall 24 because of the cranked ends of horizontal rods 80 of the end wall 30. Although it is desirable to include these cranked ends, other deformations in the structure could be made for the same purpose, i.e. to allow the walls 30 and 24 to be folded into loose engagement with one another without stressing any parts of these walls.

The bracket 72 of the latch 40 is formed from a strip of relatively rigid metal and defines first and second outwardly-facing detents 82, 84 for locating an end portion 86 of a handle 88 attached to a horizontal bolt 90. This bolt is located in a slot 92 in the bracket 72 and retained in the slot by the vertical rod 76. The bolt also slides in a pair of openings 94 (one of which is shown) formed at either side of an inwardly-facing U-shaped recess 96 defined by the bracket 72. The recess 96 has sufficient depth to receive the vertical rod 79 with the bolt 90 in the closed position shown in FIG. 4. Consequently, the latch 40 retains the wall 30 in position relative to the wall 24 on assembly of the container.

The latch detents 82, 84 prevent the handle 88 and hence the bolt 90 from moving axially with the handle in a position such as that shown in FIG. 4. However, if the handle 88 is lifted until it is generally horizontal, the end portion 86 of the handle moves into a position where it is no longer limited by the detents 82, 84 so that the handle and bolt can be moved axially to disengage the latch. This movement carries the bolt 90 out of the opening 94 seen in FIG. 4 but does not disengage the bolt from the other of the openings 94. The latch is then disengaged as shown in FIG. 5. It will be seen in this figure that the vertical rod 78 can now be disengaged from the recess 96 to disassemble the container as will be described. The latch can be retained in the disengaged position by allowing the handle 88 to fall so that the end portion 86 then locates in the detent 84.

One of the features of the latch 40 is that the vertical rod 78 is held sufficiently loosely that the wall 30 can be rotated towards the wall 24 effectively using the gate of the latch 40 as a locating hinge for the rod 78. Consequently, the container 20 (FIG. 1) can have two upper parts at opposite side walls 24, 26 to provide access from either side of the container 20 with the container in a stacked condition under other containers.

Figure 6:
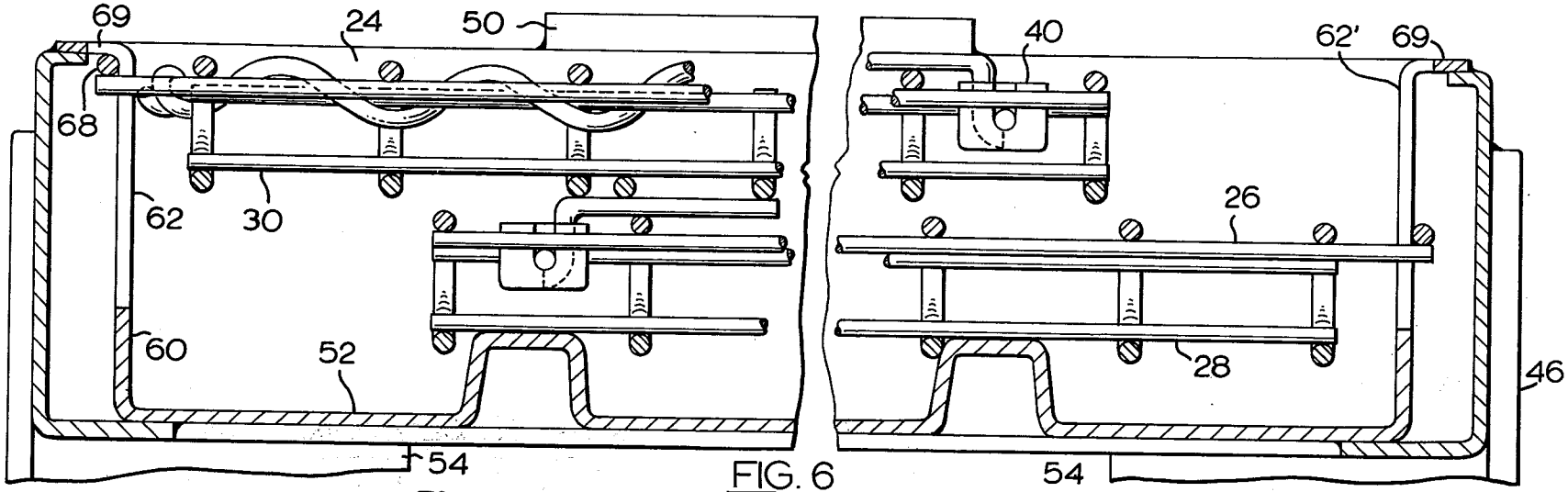
FIG. 6 is a sectional view on line 6 — 6 of FIG. 1 with the collapsible container in a disassembled condition.

Reference is now made to FIG. 6 which illustrates the container 20 in a collapsed condition. As seen in this view, the container shown in FIG. 1 has been disassembled by first disengaging the latches 42, 44, lifting the end wall 28 sufficiently to disengage it from the inner lip 48 on the sill 46, and then rotating the end wall 28 towards the side wall 26. Once these walls are in engagement with one another the latches between the side wall 26 and the end wall 30 are disengaged so that these walls can then be rotated downwardly towards the floor 52 of the base 22. The disassembled walls 26, 28 are now in the position shown in FIG. 6. Next, the wall 30 is disengaged from the lip 48 on the sill 46 and folded into engagement with the side wall 25 before folding both of these walls downwardly on top of the disassembled walls 28 and 26. In the condition shown in FIG. 6, the container 20 is disassembled and it will be seen that the walls are protected by virtue of their position below the peripheral upper extremities of the sill 46. Consequently, a further container can be stacked on the container 20 without in any way stressing the disassembled walls. This is an advantage when the containers are used for one way shipping. In such a use the containers are emptied and disassembled before being returned for re-filling. During the necessary transit there is less likelihood of damage because the container walls are totally enclosed when a further disassembled container is stacked on this disassembled container.

It will be evident from a consideration of FIG. 6, that either one of the end walls 28, 30 can be disassembled first. If the disassembly had started with the end wall 30 then the relative positions of the pairs of walls 28, 26 and 24, 30 in the disassembled condition shown in FIG. 6 would be reversed.

In some containers it may not be desirable to divide the side walls into upper and lower parts. In such containers the spiral hinge 38 shown in FIG. 1 would extend to the top of the walls 32, 30 and the latch 40 would be deleted. Also, the latch 44 could be deleted provided there was sufficient rigidity in the walls to contain a full load in the container. If preferred, the latch 44 could be retained for added strength. Similarly, if only one of the side walls is to have upper and lower parts, then a container could be designed using part of the structure shown in FIG. 1 and part of the structure just described with reference to a container having no divided side walls.

The base 46 is preferably formed from perforated aluminum alloy for lightness. Although not shown in FIG 1, a perforated floor having openings corresponding to the slots 62, 62' (FIG. 1) could be used. In this event there would be slots throughout the floor 52 positioned between the raised corrugations of the floor. This would ensure lightness combined with adequate drainage.

Figure 7:
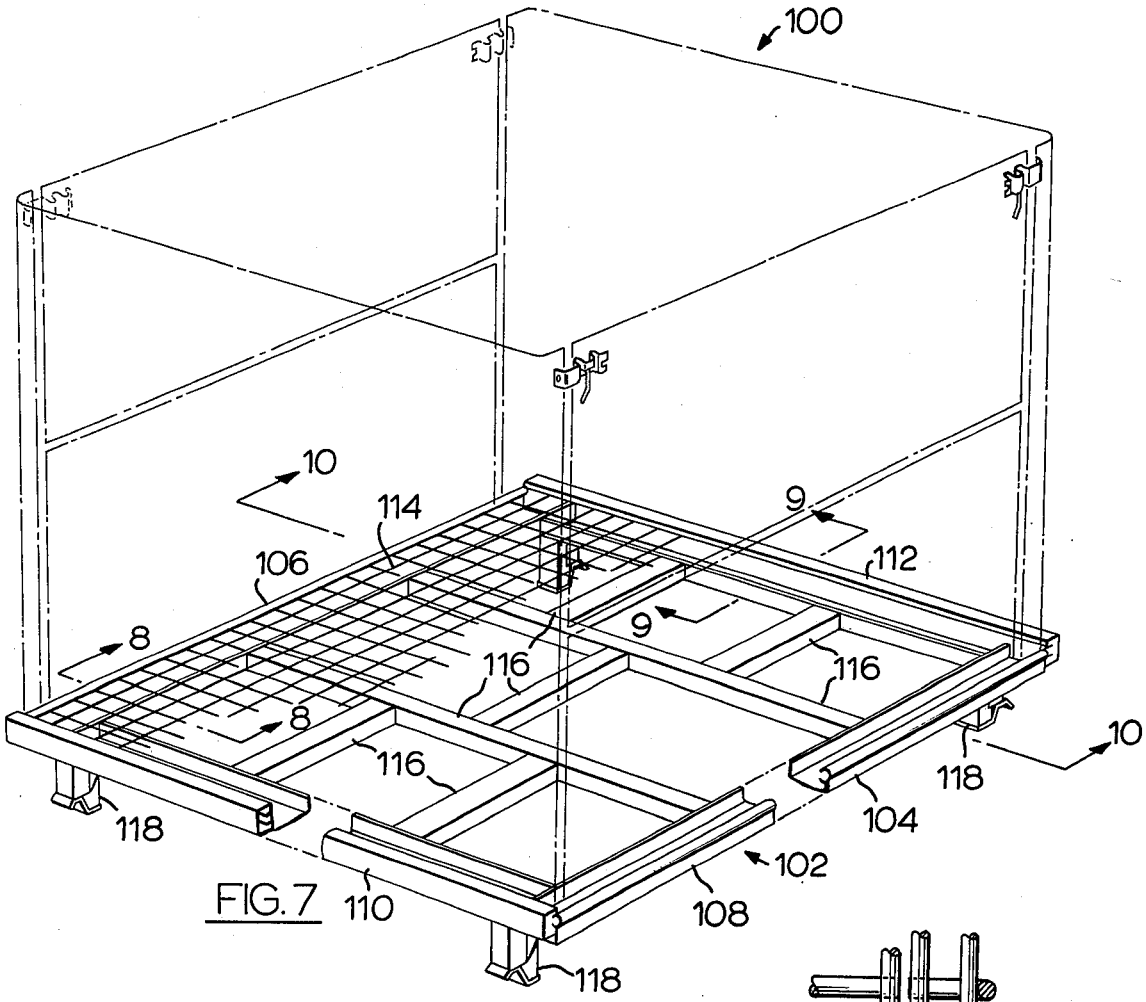
FIG. 7 is a view similar to FIG. 1 and illustrating another assembled collapsible container embodying the invention.

Reference is now made to FIG. 7 to describe a container 100 which is an alternative embodiment of the container 20 shown in FIG. 1. The container 100 differs from the container 20 in that a base 102 is used in place of the base 22 of FIG. 1. Base 102 consists of a sill 104 having a pair of side wall supports 106, 108 and a pair of end wall supports 110, 112. A floor 114 consists of orthogonally arranged rods welded to one another and supported by a framework of elements 116 which are welded to one another and to the sill 104. The framework of elements can take any convenient form provided that it is sufficiently strong to support components within the container and also relatively light to reduce the weight of the container. Four feet 118 (three of which are shown in FIG. 7) are welded to the sill 104 adjacent corners of the base 102 for stacking and supporting the container.

Figure 8:
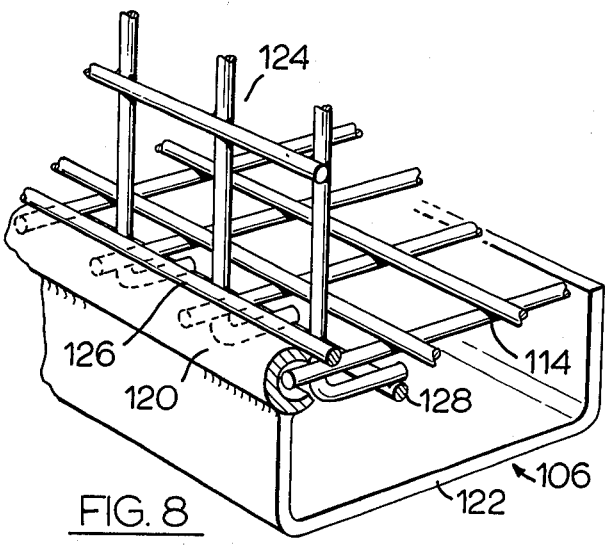
FIG. 8 is a perspective sectional view on line 8 — 8 of FIG. 7.
Figure 9:
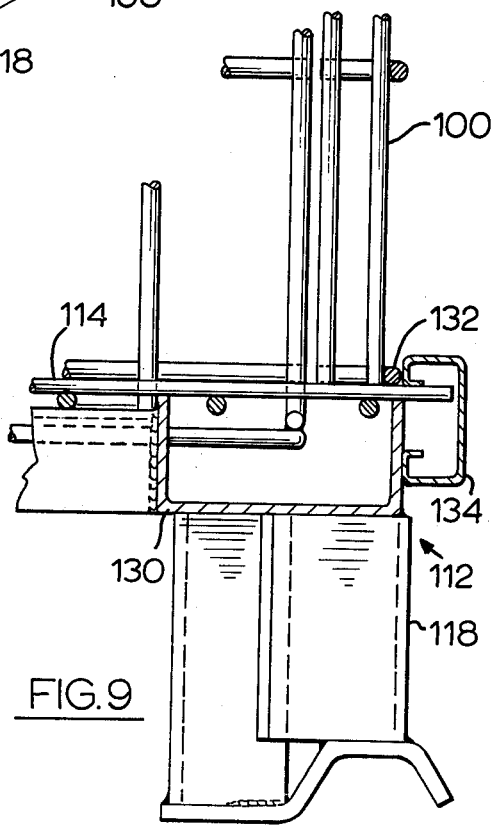
FIG. 9 is a sectional view on line 9 — 9 of FIG. 7.

As seen in FIG. 8, the floor 114 is protected at its edge by a rolled element 120 welded to an outer limb of a channel section 122 forming part of the side wall support 106. This support is similar to the support 108. A side wall 124 includes a horizontal rod 126 which rests on rods of the floor 114 engaged in the rolled element 120. Consequently, the wall 124 is supported on the floor 114 which in turn is adequately supported in the rolled element 120. Vertical rods of the wall 124 are welded to the rod 126 and have cranked ends terminating at a horizontal rod 128. The purpose of the cranked ends will be described with reference to FIG. 10. However, at this point it will be evident that the rod 128 is trapped below the floor 114 so that the wall 124 has limited movement relative to the floor 114. Reference is now made to FIG. 9 which shows a sectional view of the end wall support 112. This support is typical also of the support 110 and includes a channel section 130 supporting the floor 114. End wall 100 includes a horizontal rod 132 which rests on horizontal rods of the floor 114 adjacent a re-entrant channel section 134 which is welded to the channel section 130 in a position to receive ends of rods forming the floor 114. These rods are effectively trapped between the section 130 and the section 134 and can be welded to these sections for added strength if required. The section 134 extends above the floor 114 to locate the wall 100 and to prevent outward movement of this wall. In effect, the upper portion of the re-entrant channel section 134 corresponds to the lip 50 seen in FIG. 1. Feet 118 are welded to the under side of the channel section 130 as also seen in FIG. 7.

FIGS. 8 and 9 illustrate the support of the floor 114 on channel sections 122 and 130. Because of the shape of the channel sections, the floor is supported both at its outer extremity and also by the inner of the upward limbs forming the respective channel sections 122 and 130. This two-point support for the periphery of the floor provides adequate support for the walls which rest on the floor above the channels.

Figure 10:
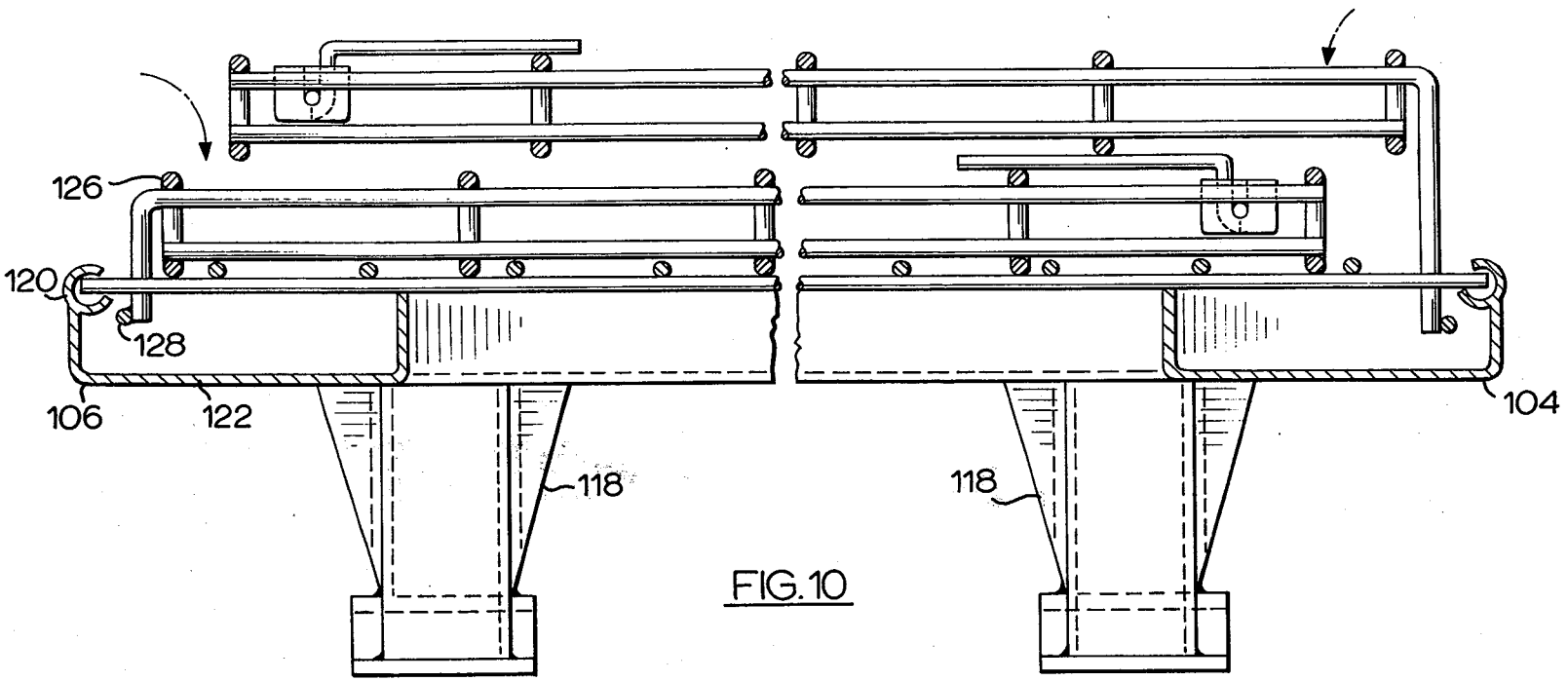
FIG. 10 is a sectional view on line 10 — 10 of FIG. 7 with this container in a disassembled condition.

As seen in FIG. 10, the wall 124 differs from the opposite side wall 136 in that the lower cranked ends of these walls are of different lengths. This is to permit the wall 136 to be folded downwardly after the wall 124 has been folded onto the base 102. It will be evident that the order in which the walls are folded is dictated by the lengths of the cranked ends of the walls 124, 136.

What I claim is:

1. A collapsible container comprising:

a rectangular base having four sided peripheral sill and a floor extending between sides of the sill, the floor being recessed below upper extremities of the sill to define a well and an opposed pair of the longer ones of said sill sides defining vertically extending slots facing inwardly of the base;

a pair of opposed side walls having vertical rods engaged in respective slots of the pair of sill sides and a respective one of a pair of horizontal rods attached to lower extremities of the respective vertical rods, each horizontal rod being housed within a respective one of the pair of sills to prevent withdrawal of the vertical rods from the pair of sills and to permit both angular movement of the pair of walls and limited translational movement of the walls vertically, said angular and translational movements combining to permit the side walls to enter the well whereby the walls are then in a disassembled condition in the well below the level of upper extremities of the sill; and a pair of end walls releasably coupled to the side walls and adapted to stand on sides of the sill between said pair of sill sides with the container assembled and to fold relative to the side walls for disassembly of the container.

2. A collapsible container as claimed in claim 1 and further comprising latches attached to the side walls and co-operable with the end walls to retain the end walls in respective assembled positions and to permit angular movement of the end walls relative to the side walls.

3. A collapsible container as claimed in claim 1 in which each latch comprises:

a bracket attached to a vertical peripheral rod of one of the walls and to a vertical further rod of this wall adjacent to said peripheral rod, the bracket defining a recess opening inwardly of the assembled container for receiving a vertical further peripheral rod of a second of the container walls adjacent to said one of the walls;

a bolt slidably located in the bracket for movement along a horizontal axis; and means attached to the bolt to limit axial movement of the bolt between an engaged position in which the bolt extends across the recess to retain said second mentioned peripheral rod in the recess and a disengaged position in which the bolt does not close the recess so that this rod can be entered into or removed from the recess thereby permitting said one wall and said second wall to be releasably coupled to one another by the latch.

4. A latch as claimed in claim 3 in which the bracket defines a pair of detents opening outwardly of the container between said first mentioned peripheral rod and said further rod and in which said bolt limit means comprises a handle attached to the bolt and having an end portion adapted to engage in the detents to selectively locate the bolt in the engaged and disengaged positions.

5. A collapsible container comprising:

a rectangular base;

a pair of side walls having respective upper and lower parts, the lower parts being coupled to respective opposed longer sides of the base for angular movement of the side walls towards the base, and the upper parts being coupled to the respective lower parts for angular movement of the upper parts outwardly from the container;

a pair of end walls positioned at respective opposed sides of the base between the side walls, each of the end walls being coupled to a respective one of the lower parts at opposed corners of the containers for angular movement of the end walls over the base and towards the respective associated side walls;

a pair of latches attached one to each of the upper portions of the side walls and adapted to releasably engage the respective end walls at said opposed corners of the container, each of these latches comprising: a bracket attached to the associated upper part of an upright periphery of this part, the bracket defining a recess opening inwardly of the container; a bolt slidably located in the bracket for movement along a horizontal axis; means attached to the bolt to limit axial movement of the bolt between an engaged position in which the bolt extends across the recess and a disengaged position in which the bolt does not close the recess; and each of said end walls having a peripheral vertical rod engaged in a corresponding said recess and held in place by the corresponding said bolt when the container is in an assembled condition and permitting said angular movement of the end walls towards the said walls when the container is being collapsed; and further latches attached to the side walls and co-operable with the end walls of the other corners of the container to releasably connect the side walls to the end walls at these corners.

6. A collapsible container comprising:

a rectangular base;

first and second side walls, the first side wall having upper and lower parts, the side walls being coupled to respective opposed sides of the base for angular movement of the side walls towards the base, and said upper part being coupled to said lower part for angular movement of the upper part outwardly from the container;

first and second end walls positioned at respective opposed sides of the base between the side walls, the first of the end walls being coupled to said lower part and the second end wall being coupled to the second side wall at opposed corners of the containers for angular movement of the end walls over the base and towards the respective associated side walls;

a pair of latches attached one to each of the ends of said upper portion of said one of the side walls and adapted to releasably engage the respective end walls at said opposed corners of the container, at least the latch associated with the first end wall comprising a bracket attached to said upper part of the first side wall at an upright periphery of this part, the bracket defining a recess opening inwardly of the container; a bolt slidably located in the bracket for movement along a horizontal axis; means attached to the bolt to limit axial movement of the bolt between an engaged position in which the bolt extends across the recess and a disengaged position in which the bolt does not close the recess; and the first end wall having a peripheral vertical rod engaged in the recess and held in place by the bolt when the container is in an assembled condition and permitting said angular movement of the first end wall towards the first side wall when the container is being collapsed; and a further latch attached to the second side wall and cooperable with the first end wall to releasably connect this side wall to this end wall to maintain the container in an assembled condition.

* * * * *